United States Patent [19]

Mori et al.

[11] Patent Number: 4,837,906

[45] Date of Patent: Jun. 13, 1989

[54] ROLLING ROLL WITH VARIABLE PROFILE AND OF THE TAPERED PISTON TYPE

[75] Inventors: Takaaki Mori; Kinichi Higuchi, both of Yokohama; Tsukasa Oyauchi, Yokohama; Masao Nitanda, Setagaya; Kohei Hosoi, Yokohama; Isao Imai, Fujisawa; Heiji Kato, Yokosuka; Mitsuhiko Ichikawa, Yokohama, all of Japan

[73] Assignee: Ishikawajima-Harima Jukogyo Kabushiki Kaisha, Japan

[21] Appl. No.: 177,779

[22] Filed: Apr. 5, 1988

[30] Foreign Application Priority Data

May 21, 1987 [JP] Japan ..... 62-124385
Dec. 15, 1987 [JP] Japan ..... 62-317239

[51] Int. Cl.[4] ..... B21B 27/00

[52] U.S. Cl. ..... 29/112; 29/116.2; 29/122; 29/130

[58] Field of Search ..... 29/112, 116.1, 116.2, 29/117, 122, 124, 125, 130; 72/20, 21, 343, 345

[56] References Cited

U.S. PATENT DOCUMENTS

| | | | |
|---|---|---|---|
| 163,217 | 5/1875 | Lawson | 29/117 |
| 763,251 | 6/1904 | Beck | 29/117 |
| 4,416,137 | 11/1983 | Marshall | 72/243 |
| 4,423,541 | 1/1984 | Marshall | 29/117 |
| 4,599,770 | 7/1986 | Kato et al. | 29/117 |
| 4,683,744 | 8/1987 | Ginzburg et al. | 72/243 |

FOREIGN PATENT DOCUMENTS

| | | | |
|---|---|---|---|
| 0104205 | 6/1984 | Japan | 72/245 |
| 1210129 | 9/1986 | Japan | 29/117 |

*Primary Examiner*—Howard N. Goldberg
*Assistant Examiner*—Irene Cuda

[57] ABSTRACT

Longitudinal axial positions in a roll longitudinal axis of ring pistons fitted into a profile-variable rolling roll are detected with a higher degree of accuracy. In response to outputs representative of the detected longitudinal axial positions of the ring pistons, the positions of the ring pistons can be controlled with a high degree of accuracy, whereby controllability of shape of the rolling roll is enhanced.

14 Claims, 7 Drawing Sheets

| | servo valve or solenoid valve (67) | | solenoid valve (66) | |
|---|---|---|---|---|
| | A | B | A | B |
| inner ring piston (45) IN | × | ○ | ○ | × |
| inner ring piston (45) OUT | ○ | × | ○ | × |
| outer ring piston (46) IN | ○ | × | × | ○ |
| outer ring piston (46) OUT | × | ○ | × | ○ |

ROLLING ROLL WITH VARIABLE PROFILE AND OF THE TAPERED PISTON TYPE

BACKGROUND OF THE INVENTION

The present invention relates to a rolling roll with variable profile and of tapered piston type.

In order to ensure satisfactory rolling operations for workpieces with any widths, various kinds of rolling means have been proposed and demonstrated. A typical example of them is a rolling mill having rolling rolls with variable profile. The rolling roll comprises a roll core on which a sleeve is fitted to define a liquid-tight chamber between an end of the sleeve and a corresponding end of the roll core. Fitted between the opposing surfaces of the ends of the sleeve and roll core, one of which is a tapered surface, is a ring piston or pistons each having a tapered surface complementary to or made into intimate contact with the first-mentioned tapered surface. With such arrangement, axial shift of the ring piston or pistons will cause radial expansion or compression of the end of the sleeve so that the roll profile may be varied into a desired shape.

With the rolling mill of the type having rolling rolls each fitted with the above-mentioned ring piston or pistons, control of the roll profile into a desired shape is assured by detecting and controlling axial position of the ring piston or pistons with a high degree of accuracy.

As mentioned above, the roll end is provided with one ring piston or a plurality of ring pistons. In the former case, the construction becomes simple; but control of the roll into a complicated shape cannot be attained. In the latter case, the construction becomes complicated; but control of the roll into a complicated shape can be attained by adjusting the positions of the ring pistons independently of each other.

FIGS. 1 and 2 show an example of a profile-variable roll equipped with three ring pistons at its each end.

A profile-variable roll 1 comprises a roll core 1a on which a sleeve 2 is shrinkage-fitted to define a barrel of the roll 1. A portion of the roll core 1a corresponding to a sleeve end 3 is defined as a stepped portion 4 having a diameter smaller than that of the sleeve 2 fitted on the roll core 1a and the inner periphery of the sleeve end 3 is tapered at a predetermined angle. Thus, a cylindrical space 5 is defined by the outer periphery of the stepped portion 4 and the tapered inner periphery of the sleeve end 3. In the space 5, a plurality of (three in FIGS. 1 and 2) ring pistons 6, 7 and 8 are fitted such that they are movable in the axial direction.

The outer peripheries of the ring pistons 6, 7 and 8 are so tapered that they are complementary to or made into intimate contact with the tapered inner periphery of the sleeve end 3. The outer peripheries of the ring pistons 6, 7 and 8 on the side adjacent to the sleeve end 3 are formed with ring grooves 12, 13 and 14 into which 0 rings 18, 19 and 20 are fitted, respectively.

A portion of the sleeve end 3 extending beyond the step portion 4 toward a journal box 21 has an inner diameter greater than the tapered inner periphery of the sleeve end 3 and has a threaded screw 22. A neck portion 24 smaller in diameter than the stepped portion 4 extends from the stepped portion 4 and is contiguous with a shaft 23. A seal ring 25 is fitted over the neck portion 24 and abuts at its one side surface on a stepped surface between the neck portion 24 and the stepped portion 4. An 0 ring 26 is inserted between the seal ring 25 and the neck portion 24 while another 0 ring 27 is inserted between the seal ring 25 and the sleeve end 3. A ring nut 28 is threadably engaged with the screw 22 to securely hold the seal ring 25 in position.

A space defined by the sleeve end 3 fitted with the ring pistons 6, 7 and 8, the stepped portion 4 and the seal ring 25 can be therefore maintained in a liquid-tight state. First to fourth oil chambers 29, 30, 31 and 32 are defined respectively on the side of the ring piston 6 away from the journal box 21, between the ring pistons 6 and 7, between the ring pistons 7 and 8 and between the ring piston 8 and seal ring 25 and are communicated with a working oil source (not shown) through respective oil passage 33, 34, 35 and 36 defined in the stepped portion 4 and neck portion 24.

Spiral grooves 37 and 38 are formed respectively on the inner and outer peripheries of the ring piston 6. The spiral groove 37 is communicated with the second oil chamber 30 while the spiral groove 38 is communicated with the first oil chamber 29. In like manner, the inner and outer peripheries of the ring piston 7 are respectively formed with spiral grooves 39 and 40, the spiral groove 39 being communicated with the third oil chamber 31 while the spiral groove 40 is communicated with the second oil chamber 30. The inner and outer peripheries of the ring piston 8 are respectively formed with spiral grooves 41 and 42, the spiral groove 41 being communicated with the fourth oil chamber 32 while the spiral groove 42 is communicated with the third oil chamber 31. These spiral grooves are so formed that they are not communicated with the ring grooves 9, 10 and 11 and the grooves 15, 16 and 17 formed on the ring pistons 6, 7 and 8. Reference numeral 43 represents a bearing; and 44, a bearing retaining plate.

With the rolling roll of the type described above, the working oil is supplied respetively into the oil chambers 29, 30, 31 and 32 to independently adjust the fitting conditions of the ring pistons 6, 7 and 8 so that the outer diameter of the end of the profile-variable roll 1 can be varied into a suitable complicated shape.

It follows therefore that when the rolling roll of the type described above is used, for instance, as a backup roll, the shape of the profile-variable roll 1 is deformed into a shape capable of absorbing a thermal crown of a work roll and the rolling operation is carried out with the sharply deformed portion of the backup roll being made into contact with the sharply deformed end portion of the thermal crown, whereby the pressing surfaces of the work rolls in contact with a workpiece being rolled can be maintained straight so that an article having a high degree of surface flatness can be produced.

The detection of the axial positions of the ring piston is made by detecting the pressure of the working oil in the hydraulic circuit for shifting the ring piston in the axial direction. However, frictional forces between the ring piston, the roll core and the sleeve are considerably high and tend to unstably vary so that in some cases the ring piston cannot be shifted in response to the pressure of the working oil. Especially in the case where a plurality of ring pistons are provided, it is difficult to confirm the actual positions of inward ring pistons so that the precise roll profile control in response to the control of the positions of the ring pistons has not been carried out so far.

The present invention was made to solve the above and other problems encountered in the prior art rolling rolls and has for its object to make it possible to detect the axial positions of the ring pistons so that a satisfactory roll profile control can be accomplished.

DETAIL DESCRIPTION OF THE PREFERRED EMBODIMENTS

Figure 1:
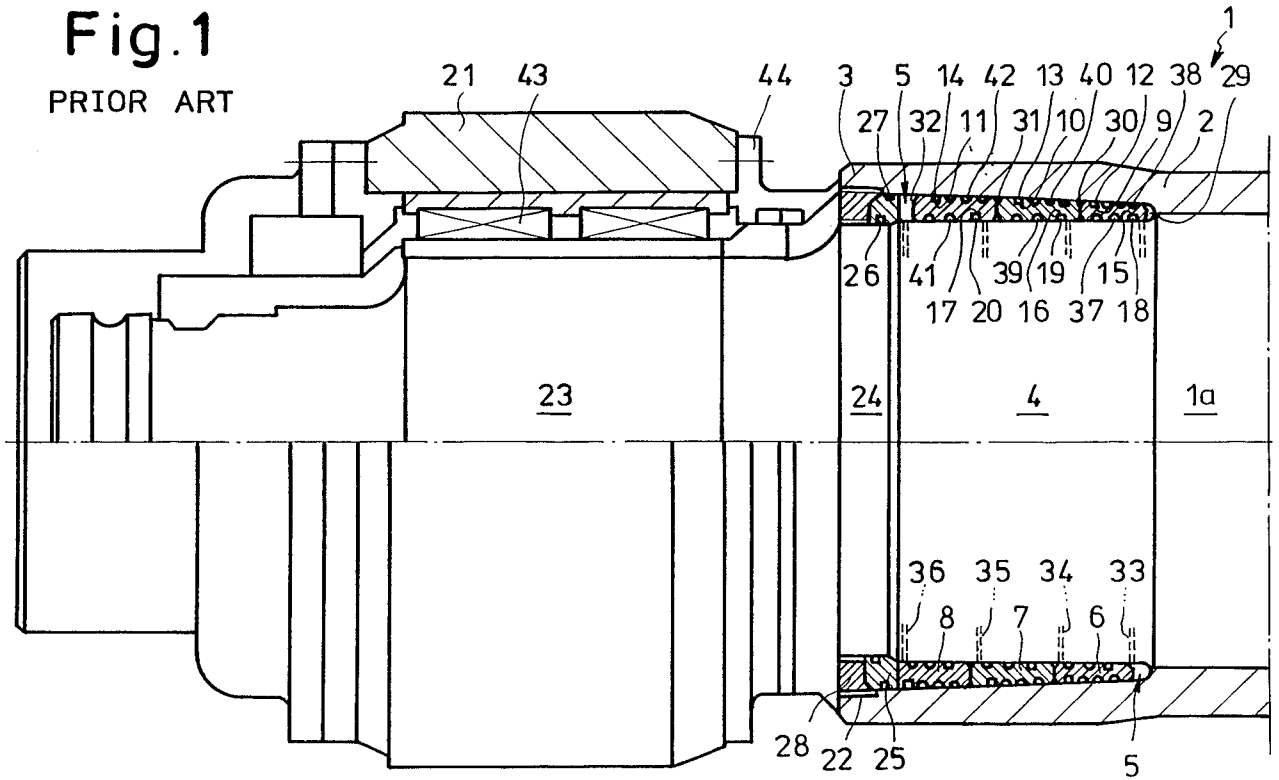
Fig. 1 PRIOR ART
FIG. 1 is a view used to explain a conventional profile-variable roll with three ring pistons.
Figure 2:
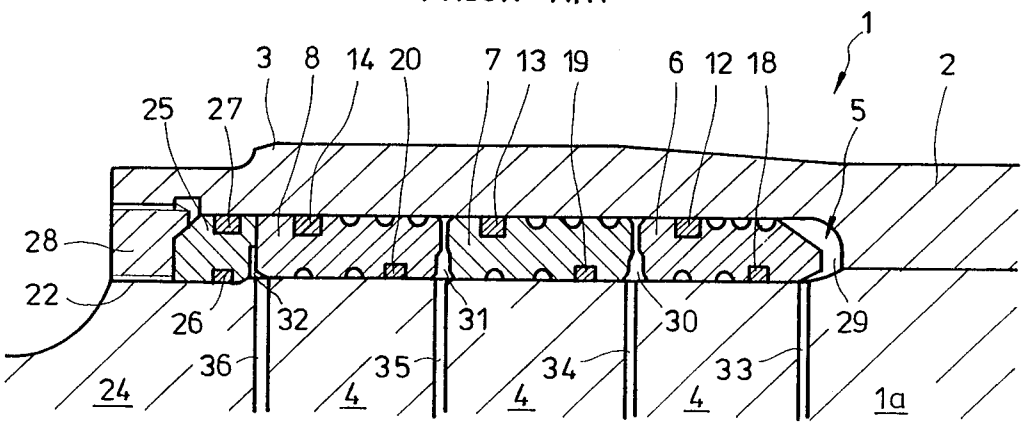
Fig. 2 PRIOR ART
FIG. 2 is a fragmentary view, on enlarged scale, thereof.
Figure 3:
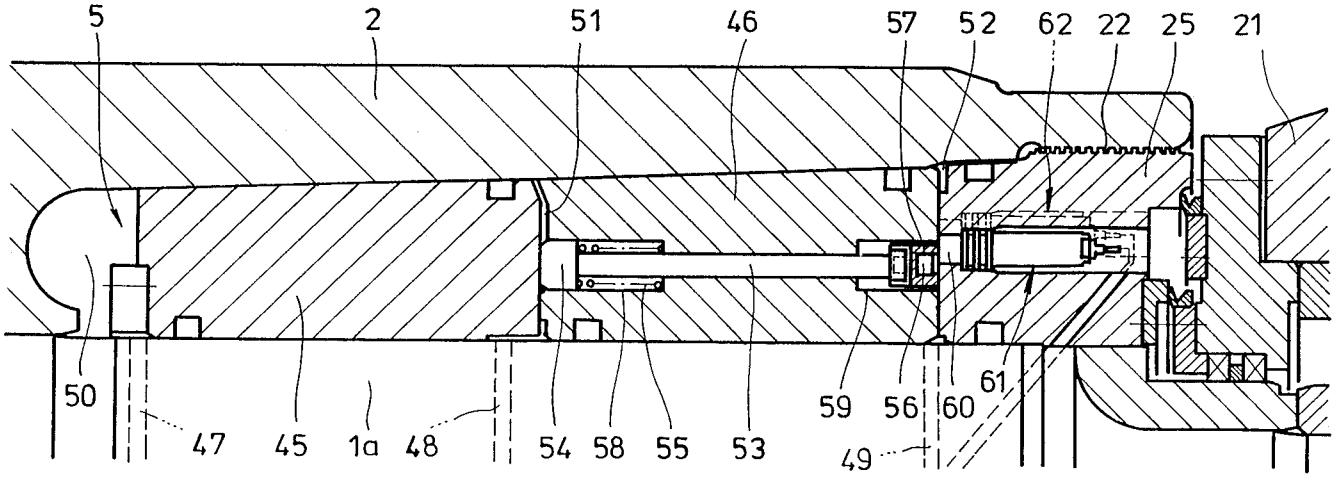
FIG. 3 is a view used to explain a rolling roll equipped with sensors for detecting the positions of the ring pistons in accordance with the present invention.

FIG. 3 shows an embodiment of a rolling roll equipped with sensors for detecting the positions of two ring pistons mounted on a profile-variable roll 1 in accordance with the present invention. Ring pistons 45 and 46 having tapered surface adapted to be complementary to or made intimate contact with the tapered surface defining a cylindrical space 5 between the roll core 1a and the end of the sleeve 2 are disposed in the space 5. Oil chambers 50, 51 and 52 to which the working oil is supplied through respective oil passages 47, 48 and 49 defined in the roll core **1*a* are defined respectively at one end of the inner ring piston 45 away from the outer ring piston 46, between the inner and outer ring pistons 45 and 46 and between the outer ring piston 46 and seal ring 25**.

A plurality of (for instance, four) shift rods 53 extend through the outer ring piston 46 equiangularly in the circumferential direction. Inner end head 54 of each shift rod 53 is normally pressed against the outer end surface of the inner ring piston 45 under the force of a bias spring 55 loaded in the outer ring piston 46. A ring plate 57 is securely joined to the outer end of each shift rod 53 by means of a screw 56 adapted to prevent the rotation of the ring plate 57. Guide openings 58 and 59 are formed to permit the shift and guidance of the head 54 and the ring plate 57 in the axial direction.

Inner-piston-position sensors 61 extend through the seal ring 25 in the axial direction and angularly spaced apart from each other in the circumferential direction (for instance, by 180°). Each sensor 61 comprises a magnetic rod 60 pressed against the outer surface of the ring plate 57 so that the position of the magnetic rod 60 is detected by a detecting coil (not shown). Reference numeral 62 represents outer-piston-position sensors each of which is angularly spaced apart from the corresponding outer-piston-position sensor 61 by 90° and forces the magnetic rod 60 to be pressed against the outer end surface of the outer ring piston 46, thereby directly detecting the axial portion of the outer ring piston 46.

With the rolling roll of the type just described above, when the axial position of the inner ring piston 45 changes, the shift rod 53 which is pressed against the outer end surface of the inner ring piston 45 under the force of the bias spring 55 is shifted in unison with the inner ring piston 45 and with the ring plate 57 securely joined to the shift rod 53. Therefore the axial position of the inner ring piston 45 can be directly detected by the inner-piston-position sensor 61 which is pressed against the outer end face of the ring plate 57 so is to detect the position thereof.

Figure 4:
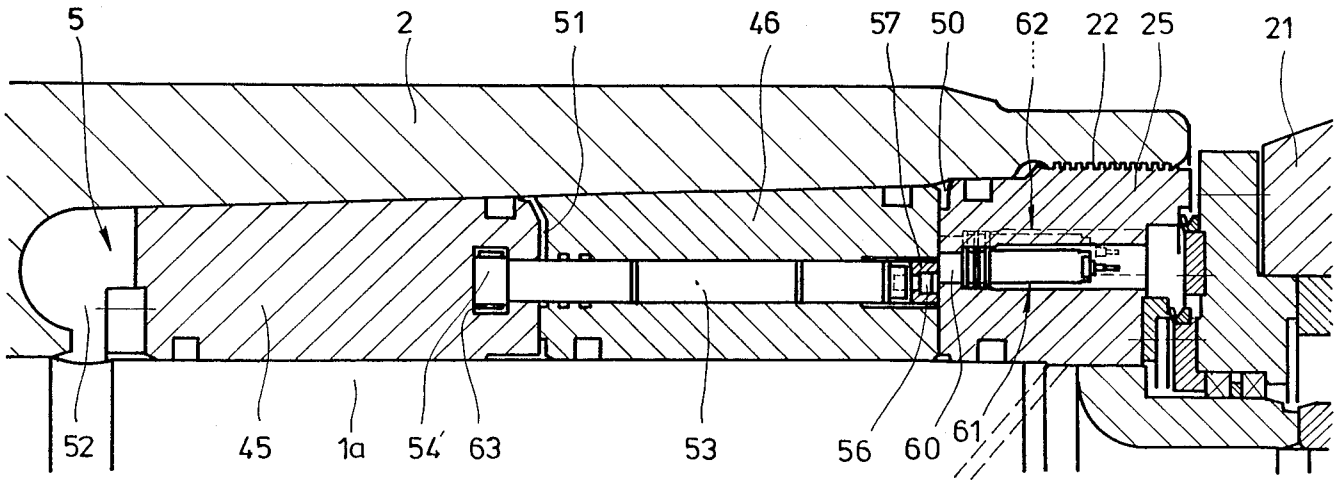
FIG. 4 shows a modification thereof.

FIG. 4 illustrates another embodiment of the present invention in which the head portion 54' of the shift rod 53 is fitted into an engaging groove 63 formed at the outer periphery of the inner ring piston 45 so that both the inner ring piston 45 and the shift rod 53 are displaced in unison. Except the above-mentioned construction, this embodiment is substantially similar in construction and in the mode of operation of the first embodiment described above with reference to FIG. 3.

Figure 5:
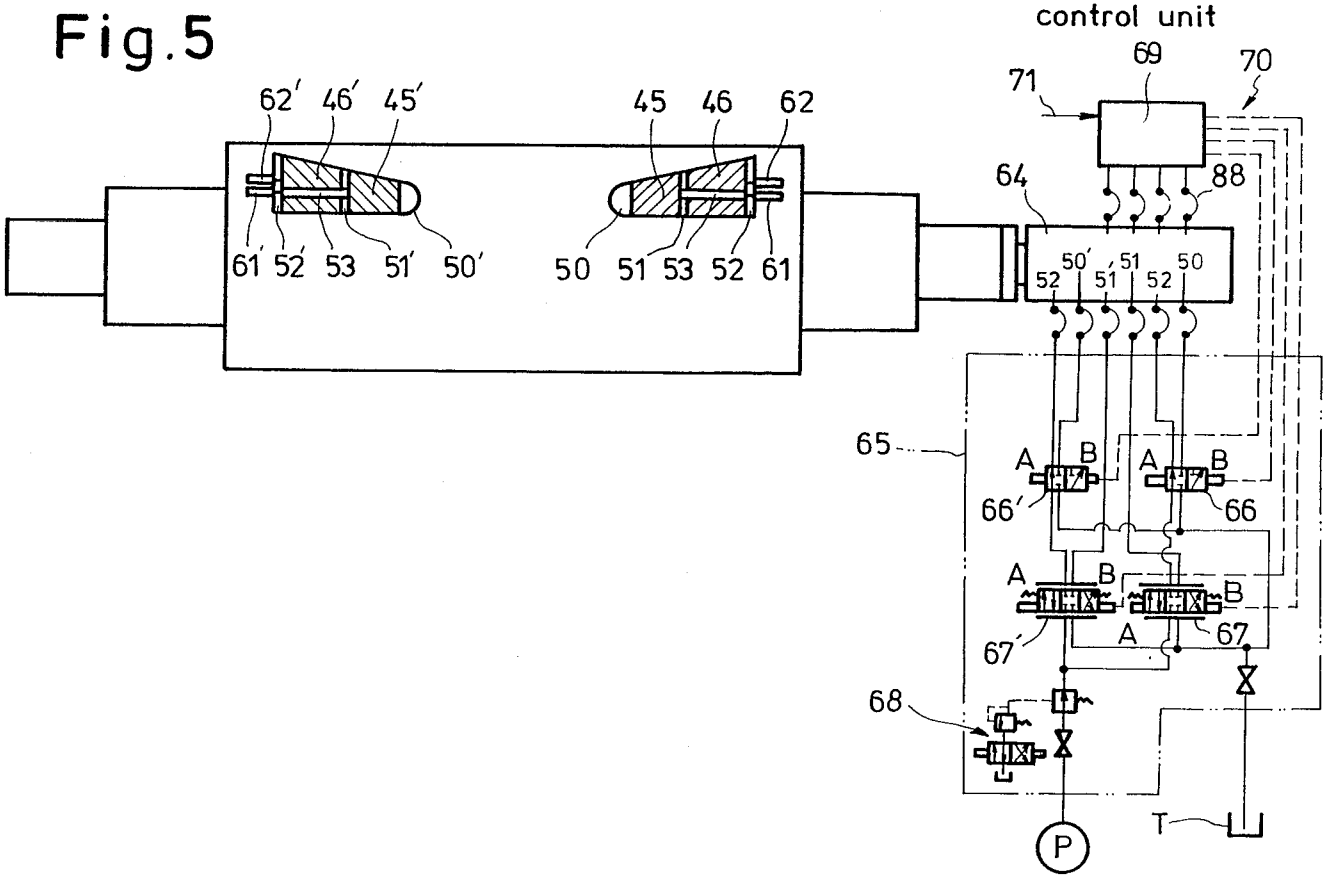
FIG. 5 is a view used to explain a control circuit for controlling the positions of the ring pistons.

FIG. 5 is a diagram of a control circuit for controlling the positions of the ring piston. The hydraulic circuit is established by extending oil passages in communication with the oil chambers 50, 51, 52, 50', 51', and 52' through the roll core 1a and communicating them through a rotary joint 64 at an end of the shaft with a position control panel 65 disposed outside of the rolling roll 1.

The solenoid valves 66 and 66' are inserted into the oil passages respectively in commuication with the oil chambers 50 and 52 and the oil passages in communication with the oil chambers 50' and 52' and a servo valve (or solenoid valve) 67 is inserted into the oil passage communicated through the solenoid valve 66 with the oil chamber 51 while another servo valve (or solenoid valve) 67' is inserted into the oil passage in communication with the oil chamber 51' through the solenoid valve 66'. The working oil is supplied from a pump P through a remote-controlled type reducing valve 68 to the servo valves (or solenoid valves) 67 and 67'. The other communication ports of the valve 66, 67, 66' and 67' are communicated with an oil tank T.

The output signals from the position sensors 61, 62, 61' and 62' are transmitted through the roll core 1a and slip rings 88 disposed in the rotary joint 64 to a control unit 69. In response to control signals 70 from the control unit 69, the solenoid valves 66 and 66' and the servo valves (or solenoid valves) 67 and 67' are controlled.

When the axial positions of the outer ring pistons 46 and 46' change, the magnetic rods 60 of the outer-piston-position sensors 62 and 62' which are pressed against the outer end faces of the outer ring pistons 46 and 46' change their positions so that the varied insertion positions of the outer ring pistons 46 and 46' can be directly detected.

When the axial positions of the inner ring pistons 45 and 45' change, the shift rods 53 pressed against the outer end faces of the inner ring piston 45 and 45' under the forces of the bias springs 55 are caused to be displaced in unison with the inner ring pistons 45 and 45' and with the ring plates 57 securely joined to the shift rods 53. As a result, the axial positions of the inner ring pistons 45 and 45' can be directly detected by the inner piston ring position sensors 61 and 61' which are pressed against the outer end surface of the ring plates 57 so as to detect their positions.

The output signals from the inner- and outer-piston-position sensors 61, 61', 62 and 62' are transmitted through the slip rings 88 to the control unit 69 and are compared with predetermined position signals 71. If there exist differences between the output signals on the one hand and the predetermined position signals 71 on the other hand, the control unit 69 delivers the control signals 70 so that the switching of the solenoid valves 66 and 66' and the servo valve (or solenoid valves) 67 and 67' is controlled, whereby the axial position of the ring pistons 45, 45', 46 and 46' are controlled at their predetermined positions.

Figures 6, 7:
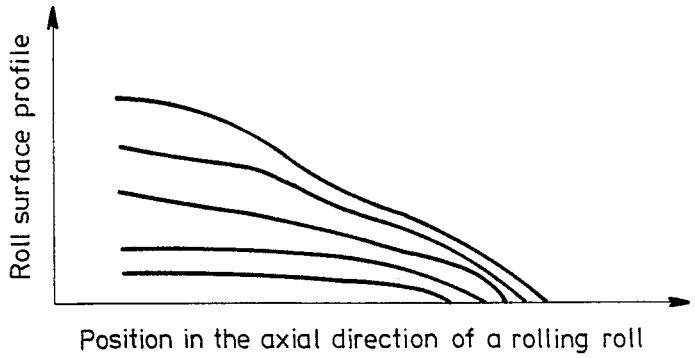
FIG. 6 is a diagram used to explain the mode of operation of the inner and outer ring pistons by solenoid and servo valves (or solenoid valves)
FIG. 7 is a graph illustrating the roll-shape deformations in accordance with the present invention.

Referring next to FIG. 6, an example of the mode of operation for controlling the positions of the inner and outer pistons by means of the valves 66 and 67 will be described. FIG. 6 shows the position control of the inner and outer ring pistons 45 and 46 by means of the valve 66 and 67; it is to be understood that the positions of the inner and outer ring pistons 45' and 46' can be also controlled.

Thus, the positions of the ring pistons 45, 45', 46 and 46' are controlled by means of the servo valves (or solenoid valves) 67 and 67' so that, by means of a narrow blind sector, their positions can be controlled with a higher degree of accuracy.

When the working oil under pressure is supplied to associated oil chambers so as to adjust the displacement of each ring piston, the outer diameter of the end of the profile-variable roll 1 can be varied as shown in FIG. 7. In additional, considerably complicated desired profiles can be obtained when the taper angle of the ring pistons and sleeve end and/or the number of ring pistons and is varied in suitable manners.

The embodiments have been described in conjunction with the double-piston type rolling roll. In the case of a rolling roll with a single piston, the piston position can be controlled by means of the outer-piston-position sensors 62 and 62', the oil passages in communication with the oil chambers 51, 52, 51' and 52' and two servo valves (or solenoid valves) 67 and 67'.

Figure 8:
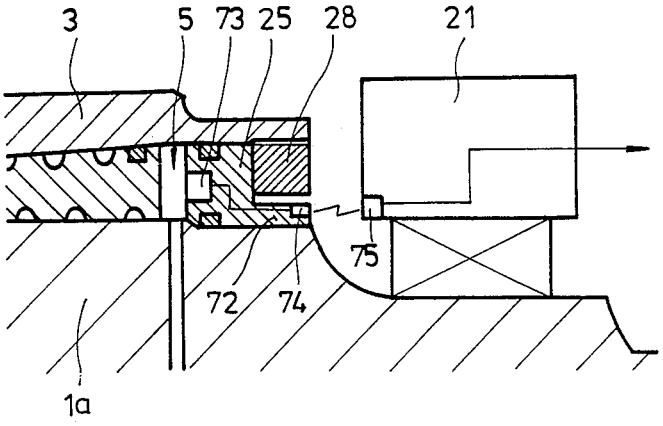
FIG. 8 is a view used to explain another embodiment of a sensor for detecting an outer or a single ring piston.

In place of the outer-piston-position sensor described above with reference to FIG. 3, a sensor of the type as shown in FIG. 8 may be used. More particularly, the seal ring 25 extends toward the journal box 21 to form an extension 72 in which transmission antenna 74 is embedded while an eddy-current position sensor 73 is embedded in the seal ring 25 adjacent to the cylindrical space 5, the transmission antenna 74 being electrically connected to the position sensor 73. A receiving antenna 75 is embedded in the journal box 21 on the side toward the sleeve end 3 and adjacent to the antenna 74 so as to receive the output signal from the position sensor 73. This detection system in which the output signal is transmitted from the transitting antenna to the receiving antenna may be equally employed to detect the position of the inner ring piston.

Even in a rolling roll with more than three ring pistons, the inventive idea and construction of the above-described inner-piston-position sensor can be equally applied to always detect and control the position of each ring piston with a high degree of accuracy.

As described above, according to the present invention, the axial positions of the ring pistons fitted in the profile-variable rolling roll is detected with a high degree of accuracy and in response to the detection output signal, the axial position of each ring piston is controlled. Therefore, the ring pistons can be located at positions with a high degree of accuracy so that the control of the profile of the rolling roll can be accomplished in a very satisfactory manner.

What is claimed is:

1. A rolling roll comprising a ring piston fitted into a cylindrical space which is defined between a roll core and longitudinal axial end of a sleeve shrinkage - fitted thereon, the roll core at said longitudinal axial end having a smaller diameter than said sleeve, and the cylindrical space having a longitudinal axial outer end sealed by a seal ring, an oil passage which is in communication with oil chambers defined at longitudinal axial outer and inner end surfaces of said ring piston through said fitting-in of said ring piston, extends through said roll core and is communicated through rotary joint means at an end of the rolling roll with valves which adjust the longitudinal position of said ring piston in the cylindrical space, position sensor means for detecting the longitudinal axial position of said ring piston and a control unit for controlling said valves in response to any difference between a setting signal and a detection output signal from said position sensor means.

2. A roll accordance to claim 1 wherein said piston sensor means is disposed in the seal ring and comprises a magnetic substance rod and a detector coil, said magnetic rod being normally pressed against the longitudinal axial outer end face of said ring piston to detect the longitudinal axial position of said ring piston.

3. A roll according to claim 1 wherein said position sensor means is disposed in the seal ring and comprises an eddy current type position sensor for detecting the position of the longitudinal axial outer end face of a the ring piston.

4. A roll according to claim 1 wherein the detection output signal from said position sensor means is transmitted through said roll core and through slip ring means disposeal at one end of said rolling roll to said control unit.

5. A roll according to claim 1 wherein the detection output signal from said position sensor means is transmitted through transmitting antenna means disposed on said seal ring and receiving antenna means disposed on a stationary member to said control unit.

6. A roll according to claim 1 wherein said valves are servo and/or solenoid valves.

7. A rolling roll comprising a plurality of ring pistons fitted into a cylindrical space defined between a roll core and longitudinal axial end of a sleeve shrinkage—fitted thereon the roll core at said longitudinal axial end having a smaller diameter than said sleeve and the cylindrical space having a longitudinal axial outer end sealed by a seal ring, an oil passage which is in communication with oil chambers defined at longitudinal axial outer and inner end surfaces of each ring piston, extends through said roll core and is communicated through rotary joint means at one end of the rolling roll with valves which adjust longitudinal axial positions of said ring pistons in the cylindrical space, position sensor means for detecting axial positions of each of the ring pistons independently of each other and a control circuit for controlling said valves in response to any difference between setting signals and detection output signals from said position sensor means.

8. A roll according to claim 7 wherein the position sensor mean for detecting the longitudinal axial position of the inner ring piston among the ring pistons fitted into the inner and outer sides in the cylindrical space comprises a shift rod which extends in the longitudinal axial direction of said rolling roll through said outer ring piston and whose one end is normally pressed against the longitudinal axial outer end face of said inner piston ring under the force of a bias spring, a ring plate attached to the other end of said shift rod, and a magnetic substance rod and a detector coil disposed in said seal ring, said magnetic substance rod being normally pressed against the longitudinal axis outer end face of said ring plate to detect the position of said inner ring piston.

9. A roll according to claim 7 wherein the position sensor means for detecting the longitudinal axial position of the inner ring piston among the ring pistons fitted into the inner and outer sides in the cylindrical space comprises a rod which extends through said outer piston ring in the longitudinal axial direction of said rolling roll and whose one end is securely joined to said inner ring piston so that the displacement with respect to said inner ring piston in the longitudinal axial direction is not permitted, a ring plate attached to the other end of said rod, and a magnetic substance rod and a detector coil disposed in said seal ring, said magnetic substance rod being normally pressed against the outer end face of the ring plate to detect the position of said ring piston.

10. A roll according to claim 7 wherein the position sensor means for detecting the longitudinal axial position of the outer ring piston among the ring pistons fitted into the inner and outer sides in the cylindrical space comprises a magnetic substance rod and a detector coil disposed in said seal ring, said magnetic substance rod being normally pressed against the longitudinal axial outer end face of said outer ring piston to detect the position of said ring piston.

11. A roll according to claim 7 wherein the position sensor means for detecting the longitudinal axial position of the outer ring piston among the ring pistons fitted into the inner and outer sides in the cylindrical space comprises an eddy-current type position sensor disposed in said seal ring for detecting the position of the longitudinal axial outer end face of said outer ring piston.

12. A roll according to claim 7 wherein the detection output signals from said position sensor means are transmitted through said roll core and slip ring means disposed at one end of said rolling roll to said control unit.

13. A roll according to claim 7 wherein the detection output signals from said position sensor means are transmitted through transmitting antenna means disposed on said seal ring and receiving antenna means disposed on a stationary member to said control unit.

14. A roll according to claim 7 wherein said valves are servo and/or solenoid valves.

* * * * *